US010755836B2

(12) United States Patent
Sagawa et al.

(10) Patent No.: US 10,755,836 B2
(45) Date of Patent: Aug. 25, 2020

(54) SIGNAL TRANSMISSION CABLE

(71) Applicant: Hitachi Metals, Ltd., Tokyo (JP)

(72) Inventors: Hideyuki Sagawa, Tokyo (JP); Takahiro Sugiyama, Tokyo (JP); Kazufumi Suenaga, Tokyo (JP); Hiroshi Ishikawa, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/251,947

(22) Filed: Jan. 18, 2019

(65) Prior Publication Data

US 2019/0228877 A1 Jul. 25, 2019

(30) Foreign Application Priority Data

Jan. 19, 2018 (JP) ..... 2018-007464

(51) Int. Cl.
*H01B 7/18* (2006.01)
*H01B 11/18* (2006.01)
*H01B 11/20* (2006.01)

(52) U.S. Cl.
CPC ..... *H01B 7/188* (2013.01); *H01B 7/1855* (2013.01); *H01B 7/1885* (2013.01); *H01B 11/18* (2013.01); *H01B 11/1834* (2013.01); *H01B 11/203* (2013.01)

(58) Field of Classification Search
CPC .... H01B 7/188; H01B 7/1885; H01B 7/1875; H01B 7/0216; H01B 7/0225; H01B 7/08; H01B 3/307; H01B 3/308; H01B 11/18; H01B 11/183; H01B 11/20; H01B 11/04; H01B 11/06; H01B 11/1834; H01B 11/1895; H01B 11/1856; B60R 16/0207
See application file for complete search history.

(56) References Cited

U.S. PATENT DOCUMENTS 3,639,674 A * 2/1972 Stier ..... H01B 9/02 174/36
4,484,023 A * 11/1984 Gindrup ..... H01B 13/2633 174/102 R
5,414,215 A * 5/1995 Dunand ..... H01B 7/0009 174/109

(Continued)

FOREIGN PATENT DOCUMENTS

JP 2005-149892 A 6/2005
JP 2005149892 A * 6/2005

(Continued)

OTHER PUBLICATIONS

Original Kuroda (JP 2005149892A) provided with Office Action (Year: 2005).*

(Continued)

*Primary Examiner* — Roshn K Varghese
(74) *Attorney, Agent, or Firm* — David D. Brush; Westman, Champlin & Koehler, P.A.

(57) ABSTRACT

A signal transmission cable includes: at least one conductor including at least one wire; a covering layer coating the at least one conductor, the covering layer being made of an insulator; a coating layer coating a periphery of the covering layer; and a plated layer coating the coating layer, the plated layer being made of a material including a metallic material.

16 Claims, 3 Drawing Sheets

(56) References Cited

U.S. PATENT DOCUMENTS

| | | | | |
|---|---|---|---|---|
| 2003/0044606 | A1* | 3/2003 | Iskander | C09J 123/06 174/107 |
| 2013/0180752 | A1* | 7/2013 | Kodama | H01B 11/1882 174/107 |
| 2016/0276759 | A1 | 9/2016 | Tran et al. | |
| 2018/0047479 | A1* | 2/2018 | Hansen | H01B 7/0216 |

FOREIGN PATENT DOCUMENTS

| | | | |
|---|---|---|---|
| JP | 2008257936 | A * | 10/2008 |
| JP | 2016-529664 | A | 9/2016 |

OTHER PUBLICATIONS

Machine Translation Kuroda (JP 2005149892A) provided with Office Action (Year: 2005).*
Original Enosaki (JP 2008257936A) provided with Office Action (Year: 2008).*
Machine Translation Enosaki (JP 2008257936A) provided with Office Action (Year: 2008).*

* cited by examiner

SIGNAL TRANSMISSION CABLE

CROSS-REFERENCE TO RELATED APPLICATIONS

This application claims the benefit of Japanese Patent Application No. 2018-007464 filed on Jan. 19, 2018 with the Japan Patent Office, the entire disclosure of which is incorporated herein by reference.

BACKGROUND

The present disclosure relates to a signal transmission cable.

Commonly known signal transmission cables each comprise: a conductive wire; a covering layer of resin provided around the conductive wire; and a conductive shielding layer provided outside the covering layer. Some conventional signal transmission cables comprise, as the shielding layer, a tape formed of layered copper and polyester and wrapped around the covering layer.

Instead of such a shielding layer configured with the tape formed of layered copper and polyester, a shielding layer formed by applying metallic plating to an outer peripheral surface of the covering layer has been proposed recently for the purposes of reducing manufacturing costs and the size of the signal transmission cable and improving the performance thereof (see, for example, Japanese Unexamined Patent Application Publication No. 2005-149892).

An end portion of the above-described signal transmission cable is stripped stepwise when the conductive wire is to be electrically connected to a substrate or the like (see, for example, Published Japanese Translation of PCT International Publication for Patent Application No. 2016-529664). The stepwise stripping is a process of exposing a core wire of the signal transmission cable and also a process of removing (stripping off) the shielding layer from the covering layer. As a result of the stepwise stripping, the exposed core wire and an end of the shielding layer are spaced apart from each other in a longitudinal direction of the signal transmission cable. This makes it easier to secure a distance between a contact between the conductive wire and the substrate and a contact between the shielding layer and the substrate, thus facilitating insulation.

SUMMARY

The signal transmission cable having the shielding layer formed by applying metallic plating to the outer peripheral surface of the covering layer, which is disclosed in Japanese Unexamined Patent Application Publication No. 2005-149892, has been problematic in that the above-described process of stepwise stripping is difficult to perform. Specifically, the metal-plated shielding layer has stronger adhesion to the covering layer than the shielding layer configured with the tape formed of layered copper and polyester. Thus, in performing the stepwise stripping, it is difficult to strip off the metal-plated shielding layer from the covering layer, thus making the stepwise stripping difficult.

Another problem is that insulation between the conductive wire and the shielding layer is difficult to secure due to the difficulty in performing the process of stepwise stripping. Specifically, since the shielding layer is difficult to strip off from the covering layer, it is difficult to secure a distance between the conductive wire and the end of the shielding layer, thus causing the difficulty in securing insulation between the conductive wire and the shielding layer.

It is desirable that the present disclosure provides a signal transmission cable enabling reduction of the cable size and facilitation of the process of stepwise stripping.

A signal transmission cable of one aspect of the present disclosure comprises: at least one conductor comprising at least one wire; a covering layer coating the at least one conductor, the covering layer being made of an insulator; a coating layer coating a periphery of the covering layer; and a plated layer coating the coating layer, the plated layer being made of a material comprising a metallic material. An adhesion strength between the covering layer and the coating layer is lower than an adhesion strength between the coating layer and the plated layer.

In the signal transmission cable of the present disclosure, the adhesion strength between the covering layer and the coating layer is made lower than the adhesion strength between the coating layer and the plated layer. This allows the plated layer to be removed together with the coating layer from the covering layer and the at least one conductor in the process of stepwise stripping. Consequently, even when the plated layer is used as a shielding layer of the signal transmission cable to reduce the cable size, the process of stepwise stripping for removing the shielding layer (i.e., the plated layer) can be easily performed.

The signal transmission cable of the present disclosure exerts an effect of enabling reduction of the cable size and facilitation of the process of stepwise stripping because the adhesion strength between the covering layer and the coating layer is made lower than the adhesion strength between the coating layer and the plated layer.

BRIEF DESCRIPTION OF THE DRAWINGS

Embodiments of the present disclosure will be described below with reference to the accompanying drawings, in which.

DETAILED DESCRIPTION OF EXEMPLARY EMBODIMENTS

Figure 1:
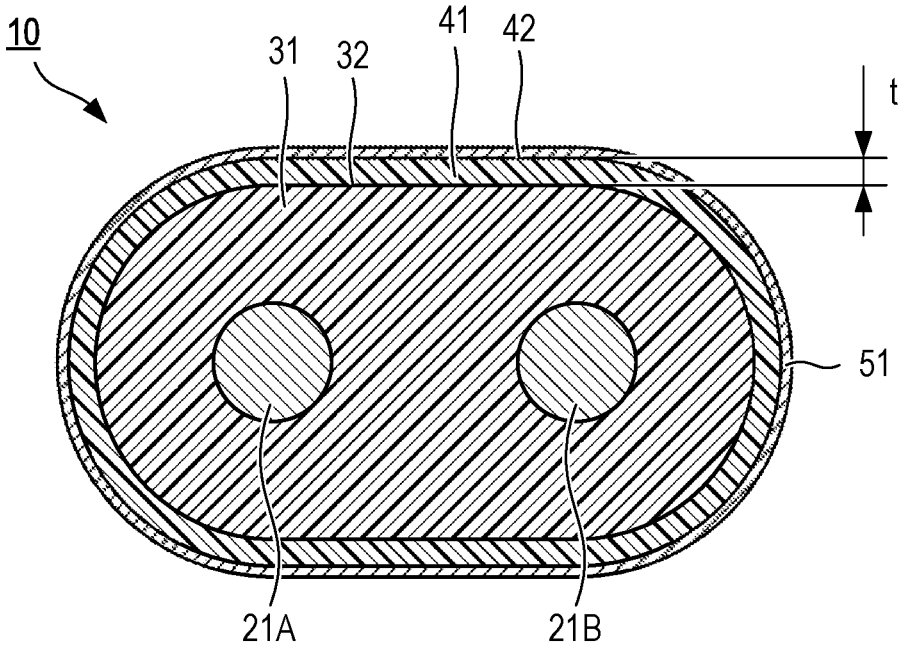
FIG. 1 is a schematic sectional view illustrating a configuration of a signal transmission cable according to one embodiment of the present disclosure.
Figure 2:
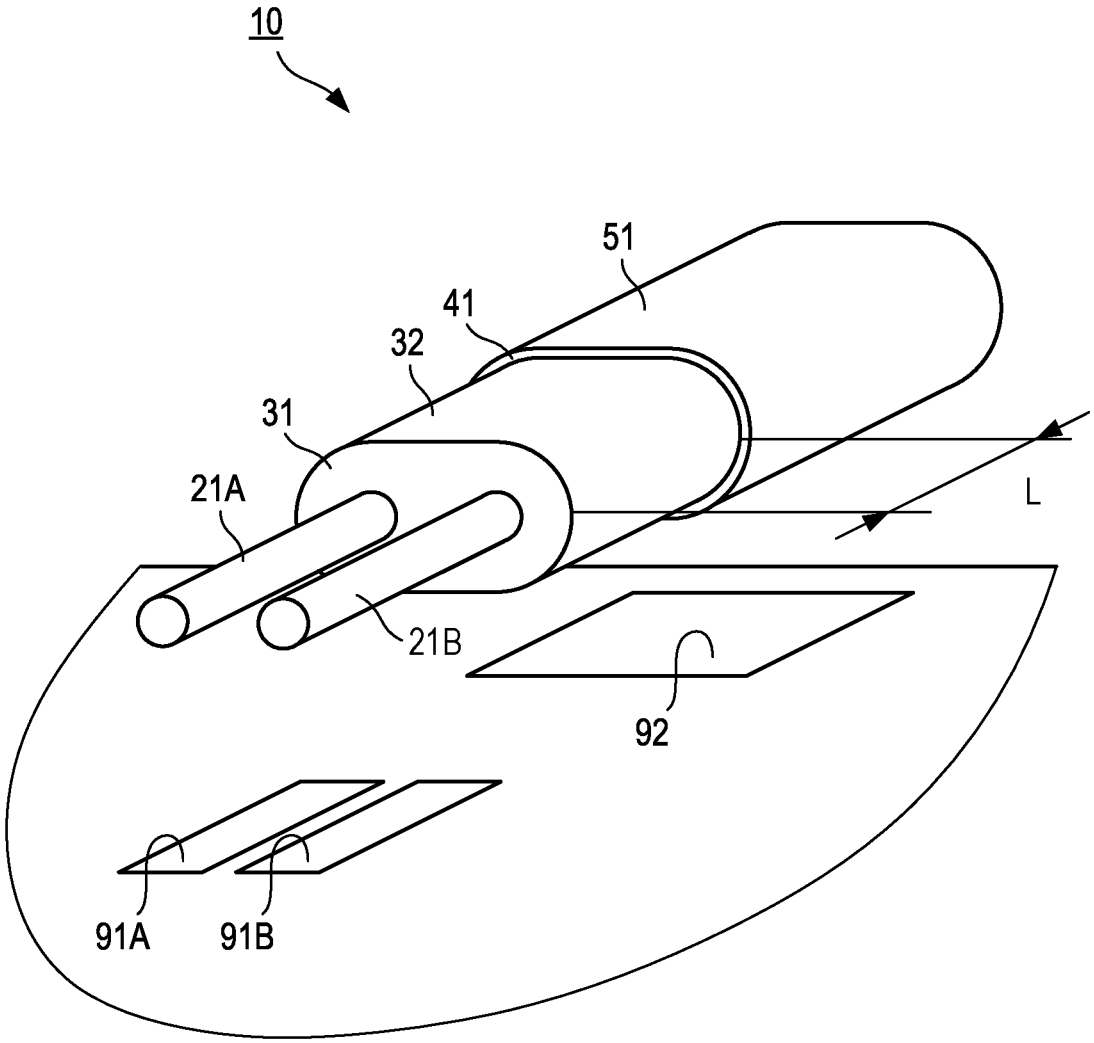
FIG. 2 is a schematic view illustrating an end portion of the signal transmission cable in FIG. 1, which has undergone a process of stepwise stripping.

A signal transmission cable 10 according to one embodiment of the present disclosure will be described below with reference to FIGS. 1 and 2.

In the present embodiment, the present disclosure is applied to the signal transmission cable 10 comprising first and second signal-line conductors (i.e., at least one conductor) 21A and 21B. As shown in FIG. 1, the signal transmission cable 10 comprises the first and second signal-line conductors 21A and 21B, a covering layer (i.e., a first insulator) 31, a coating layer (i.e., a second insulator) 41, and a plated layer 51, as main components.

The first and second signal-line conductors 21A and 21B are used to transmit electric signals. Each of the first and second signal-line conductors 21A and 21B comprises one or more wires formed of metallic material containing, for example, copper or copper alloy. One of the first and second signal-line conductors 21A and 21B is a conductor for transmitting a positive signal as a differential signal, and the other is a conductor for transmitting a negative signal as a differential signal.

The covering layer 31 coats the first and second signal-line conductors 21A and 21B. In the present embodiment, an example will be described in which a cross-sectional shape of the covering layer 31 is a shape formed by two parallel lines equal in length and two semicircles. A specific shape of the covering layer 31 may be the above-described shape or may be other shapes, such as a substantially elliptical shape.

The first and second signal-line conductors 21A and 21B are arranged so as to be spaced apart at a specified interval within the covering layer 31. The covering layer 31 is provided so as to have at least a specified thickness around the first and second signal-line conductors 21A and 21B.

In the present embodiment, an example will be described in which the covering layer 31 is formed of fluororesin. The fluororesin is typified by polytetrafluoroethylene (PTFE), and well-known resins may also be used, such as polyvinyl fluoride (PVF), ethylene-tetrafluoroethylene copolymer (ETFE), perfluoroalkoxy fluororesin (PFA), tetrafluoroethylene-hexafluoropropylene copolymer (FEP), and polyvinylidene fluoride (PVDF). The covering layer 31 may be formed of the fluororesin or may be formed of other resins that meet the conditions, such as insulating properties, required for the covering layer 31.

An outer peripheral surface of the covering layer 31, or in other words a covering outer peripheral surface 32 facing the coating layer 41, is not subjected to a modification treatment for surface-roughening and/or hydrophilization. For example, the covering outer peripheral surface 32 remains in a state where the covering layer 31 is formed into a cable-like shape by a compression method or an extrusion method.

The coating layer 41 coats the covering layer 31. The coating layer 41 is provided so as to adhere closely to the covering outer peripheral surface 32 of the covering layer 31. In other words, the coating layer 41 is provided so as to be in a similar contacting state overall in a circumferential direction thereof and overall in a longitudinal direction thereof. The coating layer 41 is formed such that its thickness t is 50 μm or less.

In the present embodiment, an example will be described in which the coating layer 41 is formed of a resin, such as high-density polyethylene (HDPE), which is different from the fluororesin. The coating layer 41 may be formed of expanded polyethylene or may be formed of other resins that meet the conditions, such as insulating properties, required for the coating layer 41.

An outer peripheral surface of the coating layer 41, or in other words a coating outer peripheral surface 42 facing the plated layer 51, is subjected to the modification treatment for surface-roughening and/or hydrophilization. Here, examples of the modification treatment may include blasting, a treatment of radiating high energy, such as plasma, corona, ultraviolet rays, electron beams, and ion beams, and a treatment of immersing in acidic solution, alkaline solution, or solution containing high-concentration of oxygen or ozone.

The plated layer 51, which is formed on the coating outer peripheral surface 42 of the coating layer 41, reduces the influence of external noises. The plated layer 51 is a conductive layer formed by plating with metallic material containing copper or copper alloy. In the present embodiment, an example will be described in which the plated layer 51 is formed of the metallic material containing copper or copper alloy. The plated layer 51 may be formed of other conductive materials, such as metallic material containing silver or silver alloy.

The adhesion strength between the covering layer 31 and the coating layer 41 is lower than the adhesion strength between the coating layer 41 and the plated layer 51.

Next, an explanation will be given, with reference to FIG. 2, of a configuration of an end portion of the above-described signal transmission cable 10, which has undergone a process of stepwise stripping.

The end portion of the signal transmission cable 10 is stripped stepwise sequentially in its longitudinal direction. In the process of stepwise stripping, the plated layer 51 and the coating layer 41 at the end portion of the signal transmission cable 10 are stripped off, thus forming a region where the covering layer 31 is exposed.

For example, a groove having a depth reaching the covering layer 31 is formed annularly overall in a circumferential direction of the signal transmission cable 10. Then, a layered part of the plated layer 51 and the coating layer 41 located on the end side with respect to the groove is stripped off, to thereby expose the covering layer 31. Examples of a method for forming the above-described groove may include a method of irradiating the signal transmission cable 10 with laser beam, such as carbon dioxide laser.

Subsequently, an end-side part of the exposed covering layer 31 is stripped off, thus forming a region where the first and second signal-line conductors 21A and 21B are exposed. In this way, the first and second signal-line conductors 21A and 21B are exposed at an end-side part of the end portion of the signal transmission cable 10, and next thereto the covering layer 31 is exposed. A method for exposing the first and second signal-line conductors 21A and 21B may be a well-known method.

The exposed parts of the first and second signal-line conductors 21A and 21B are electrically connected to signal-line conductor pads 91A and 91B, respectively, which are provided to a connector, a substrate, or the like to which the signal transmission cable 10 is to be connected. The plated layer 51 is electrically connected to a ground pad 92, which is grounded.

It is acceptable that the length (i.e., the longitudinal length) L of the exposed part of the covering layer 31 is long enough to be able to securely insulate the first and second signal-line conductors 21A and 21B from the plated layer 51. The length L is not limited by specific values.

[Method for Comparing Adhesion Strength]

Next, a method for comparing the adhesion strength will be described.

First, grooves having a depth at least reaching the covering layer 31 are formed in a grid-like manner on an area of an outer peripheral surface of the signal transmission cable 10, which is used for comparison. Next, an adhesive tape is applied to the area on the signal transmission cable 10 where the grooves have been formed, and then the adhesive tape is removed.

A thin slice of the signal transmission cable 10 adheres to the adhesive tape and is removed together with the adhesive tape. Then, a material on the thin slice on an opposite side from the adhesive tape is analyzed. If the material for forming the covering layer 31 is detected by the analysis, then it is determined that the adhesion strength between the covering layer 31 and the coating layer 41 is lower than the adhesion strength between the coating layer 41 and the plated layer 51.

On the other hand, if the material for forming the plated layer 51 is detected, then it is determined that the adhesion strength between the covering layer 31 and the coating layer 41 is higher than the adhesion strength between the coating layer 41 and the plated layer 51.

[Effects of Embodiment]

In the signal transmission cable 10 configured as above, the adhesion strength between the covering layer 31 and the coating layer 41 is set to be lower than the adhesion strength between the coating layer 41 and the plated layer 51. This allows the plated layer 51 to be removed together with the coating layer 41 from the covering layer 31 and the first and second signal-line conductors 21A and 21B in the process of stepwise stripping. Consequently, even when the plated layer 51 is used as a shield of the signal transmission cable 10 to reduce the cable size, the process of stepwise stripping for removing the plated layer 51 can be easily performed.

The covering layer 31 and the coating layer 41 are respectively formed of PTFE and expanded polyethylene, which are mutually different insulators. This makes it easier to improve the noise characteristics and to facilitate the process of stepwise stripping of the signal transmission cable 10. Specifically, a material capable of improving the noise characteristics may be employed as the material for forming the covering layer 31, and a material capable of facilitating the process of stepwise stripping may be employed as the material for forming the coating layer 41.

The modification treatment is applied to the coating outer peripheral surface 42 of the coating layer 41, which faces the plated layer 51. This makes it easier to increase the adhesion strength between the coating layer 41 and the plated layer 51, as compared with a case where the modification treatment is not applied. The coating outer peripheral surface 42 is a surface on which the plated layer 51 is to be formed. Application of the modification treatment to the surface facing the plated layer 51 facilitates formation of the plated layer 51 and increase in the adhesion strength between the coating layer 41 and the plated layer 51.

The modification treatment is not applied to the covering outer peripheral surface 32 of the covering layer 31, which faces the coating layer 41. This makes it easier to decrease the adhesion strength between the covering layer 31 and the coating layer 41, as compared with a case where the modification treatment is applied. The covering outer peripheral surface 32 is a surface on which the coating layer 41 is to be formed. Absence of the application of the modification treatment to the covering outer peripheral surface 32 facilitates decrease in the adhesion strength between the covering layer 31 and the coating layer 41.

The covering layer 31 and the coating layer 41 adhere closely to each other. This facilitates reduction of deterioration of the noise characteristics of the signal transmission cable 10, as compared with a case where intermittent gaps are present between the covering layer 31 and the coating layer 41, or in other words, as compared with a case where the covering layer 31 and the coating layer 41 contact with each other intermittently.

The plated layer 51 contains metallic material or composite material including metallic material, or contains copper or composite material including copper. This enables the plated layer 51 to function as a shield.

The thickness of the coating layer 41 is 50 μm or less. This facilitates reduction of deterioration of the noise characteristics of the signal transmission cable 10. In particular, in the case where the size of the signal transmission cable 10 is reduced, reduction of deterioration of the noise characteristics is facilitated.

[Other Embodiments]

Figure 3:
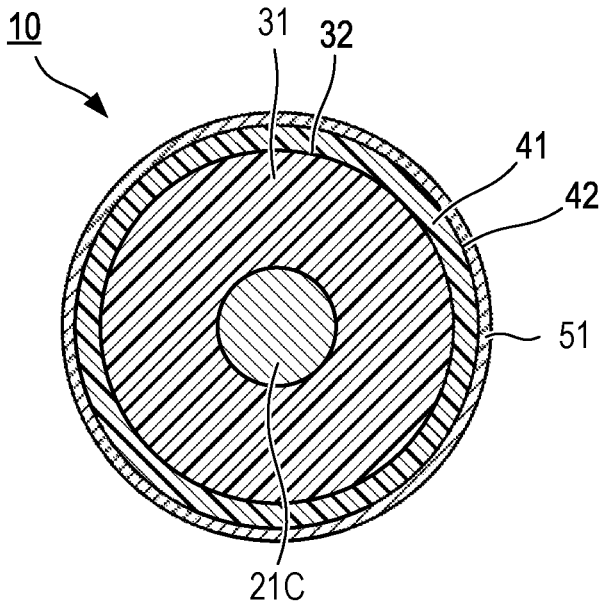
FIG. 3 is a schematic sectional view illustrating a configuration of a signal transmission cable according to another embodiment of the present disclosure.

The technical scope of the present disclosure is not limited to the above-described embodiment, but various modifications can be made without departing from the gist of the present disclosure. For example, in the above-described embodiment, an explanation has been given of the example in which the signal transmission cable 10 comprises the first and second signal-line conductors 21A and 21B; however, as shown in FIG. 3, the signal transmission cable 10 may comprise a single signal-line conductor 21C. The number of signal-line conductors is not limited specifically.

What is claimed is:

1. A signal transmission cable comprising:

at least one conductor comprising at least one wire;

a covering layer coating the at least one conductor, the covering layer being made of an insulator;

a coating layer coating a periphery of the covering layer; and a plated layer coating the coating layer, the plated layer being made of a material comprising a metallic material, wherein the coating layer comprises a surface roughened or hydrophilic area facing the plated layer, applied with a modification treatment for roughening or hydrophilization, such that an adhesion strength between the covering layer and the coating layer is lower than an adhesion strength between the coating layer and the plated layer.

2. The signal transmission cable according to claim 1, wherein the covering layer is made of a first insulator, and wherein the coating layer is made of a second insulator, which is different from the first insulator.

3. The signal transmission cable according to claim 1, wherein the covering layer lacks a surface roughened or hydophilic hydrophilic area facing the coating layer applied with a modification treatment for roughening or hydrophilization.

4. The signal transmission cable according to claim 1, wherein the covering layer is made of a fluororesin.

5. The signal transmission cable according to claim 1, wherein the covering layer and the coating layer adhere closely to each other.

6. The signal transmission cable according to claim 1, wherein the plated layer comprises a metallic material or a composite material comprising a metallic material.

7. The signal transmission cable according to claim 1, wherein the coating layer has a thickness of 50 μm or less.

8. The signal transmission cable according to claim 1, wherein the at least one wire comprises a plurality of wires.

9. The signal transmission cable according to claim 1, wherein the at least one conductor comprises a plurality of conductors.

10. The signal transmission cable according to claim 1, wherein the modification treatment for roughening or hydrophilization is one or more of blasting, a treatment of radiating high energy, such as plasma, corona, ultraviolet rays, electron beams, and ion beams, and a treatment of immersing in acidic solution, alkaline solution, or solution containing high-concentration of oxygen or ozone.

11. An electrical connection structure between an electronic component and the signal transmission cable according to claim 1, wherein an end of the signal transmission cable is stripped stepwise in a longitudinal direction so that the conductor, the covering layer, and the plated layer are sequentially exposed, wherein the conductor that is exposed is electrically connected to a conductor pad provided on the electronic component, and wherein the plated layer that is exposed is electrically connected to a ground pad provided on the electronic component.

12. The electrical connection structure according to claim 11, wherein in a boundary portion between the covering layer and the plated layer, the covering layer includes a groove portion formed annularly overall in a circumferential direction of the signal transmission cable.

13. A method for producing a signal transmission cable, comprising:

providing at least one conductor comprising at least one wire;

providing a covering layer coating the at least one conductor, the covering layer being made of an insulator;

providing a coating layer coating a periphery of the covering layer;

providing a plated layer coating the coating layer, the plated layer being made of a material comprising a metallic material; and applying an area facing the plated layer in the coating layer with a modification treatment for roughening or hydrophilization such that an adhesion strength between the covering layer and the coating layer is lower than an adhesion strength between the coating layer and the plated layer.

14. The method according to claim 13, wherein the modification treatment for roughening or hydrophilization is one or more of blasting, a treatment of radiating high energy, such as plasma, corona, ultraviolet rays, electron beams, and ion beams, and a treatment of immersing in acidic solution, alkaline solution, or solution containing high-concentration of oxygen or ozone.

15. An electrical connection method between an electronic component and the signal transmission cable obtained by the method according to claim 13, comprising:

stripping an end of the signal transmission cable stepwise in a longitudinal direction so that the conductor, the covering layer, and the plated layer are sequentially exposed, electrically connecting the conductor that is exposed to a conductor pad provided on the electronic component, and electrically connecting the plated layer that is exposed to a ground pad provided on the electronic component.

16. The electrical connection method according to claim 15, wherein the covering layer that is exposed is formed by irradiating the signal transmission cable with laser beam overall in a circumferential direction of the signal transmission cable to annularly form a groove having a depth reaching the covering layer, and then stripping off the plated layer and the coating layer located on an end side with respect to the groove.

* * * * *